United States Patent [19]

Nate et al.

[11] Patent Number: 4,689,073

[45] Date of Patent: Aug. 25, 1987

[54] METHOD FOR PRODUCTION OF RARE-EARTH ELEMENT/COBALT TYPE MAGNETIC POWDER FOR RESIN MAGNET

[75] Inventors: Tatsuo Nate; Koichi Oka, both of Ichikawa; Takehiko Sato, Musashino, all of Japan

[73] Assignee: Sumitomo Metal Mining Company Limited, Tokyo, Japan

[21] Appl. No.: 834,420

[22] Filed: Feb. 28, 1986

[30] Foreign Application Priority Data

Feb. 28, 1985 [JP] Japan ..... 60-37703
Mar. 7, 1985 [JP] Japan ..... 60-43817

[51] Int. Cl.[4] ..... H01F 1/33
[52] U.S. Cl. ..... 75/0.5 BA
[58] Field of Search ..... 75/0.5 BA, 0.5 AA

[56] References Cited

U.S. PATENT DOCUMENTS 3,959,032 5/1976 Koester ..... 75/0.5 BA
4,378,258 3/1983 Clark ..... 420/416

*Primary Examiner*—Peter D. Rosenberg

*Attorney, Agent, or Firm*—Watson, Cole, Grindle & Watson

[57] ABSTRACT

A rare earth-element/cobalt type magnetic powder which possesses outstanding magnetic properties and which is useful for making a resin magnet is produced by a method which comprises thermally reducing a mixture consisting of oxide of samarium, oxide of praseodymium, optionally oxide of neodymium, and cobalt powder, thereby causing diffusion of consequently produced samarium, praseodymium, and/or neodymium in the cobalt powder, subjecting the resultant reaction product to a heat-treatment involving standing at 600° to 900° C. for 30 minutes to 5 hours and subsequent quenching from this temperature at a rate of not less than 10° C./minute, adding the product of the heat-treatment to water, thereby converting the product into a slurry, treating the slurry with water and an aqueous acid solution, and comminuting the resulting powder into particles of an average diameter of 3 to 10 μm thereby obtaining a magnetic powder having a composition represented by $Sm_{1-x}Pr_xCo_z$ or $Sm_{1-x}Pr_{x-y}Nd_yCo_z$ (wherein x, y, and z satisfy the relations $0.05 \leqq x \leqq 0.40$, $0.01 \leqq y \leqq 0.39$, $0.01 \leqq x-y \leqq 0.39$ and $4.7 \leqq z \leqq 5.3$).

9 Claims, No Drawings

METHOD FOR PRODUCTION OF RARE-EARTH ELEMENT/COBALT TYPE MAGNETIC POWDER FOR RESIN MAGNET

BACKGROUND OF THE INVENTION

1. Field of the Invention

This invention relates to a method for the production of a rare-earth element/cobalt magnet powder substantially composed of (1-5) single phase by a reduction diffusion process, the magnetic powder showing excellent magnetic properties and is suitable for a resin magnet.

2. Description of the Prior Art

A rare-earth/cobalt magnetic powder substantially composed of (1-5) phase for use in a resin magnet has a sufficiently small particle diameter to display high magnetic properties and proves advantageous in compatibility with resin and in flowability and homogeneity required during the blending and molding works as compared with a magnetic powder substantially composed of (2-17) phase. Thus, it has found favorable acceptance. As a means of producing a magnetic powder substantially composed of (1-5) phase there has been adopted the so-called reduction-diffusion method, which comprises mixing the oxide of a rare earth element, a reducing agent such as metallic calcium, and cobalt powder, placing the resulting mixture in a container and heating it in an atmosphere of an inert gas under atmospheric pressure at 900° C. to 1,100° C., adding the resultant reaction product to water, thereby producing a slurry, and treating the slurry with water and an aqueous acid solution.

This method, however, affords as a reaction product of reduction-diffusion nothing other than a magnetic powder such as to acquire a mean composition of the (1-5) phase. When magnetic powder obtained by this method is finely comminuted and press molded, then thermally treated for improvement of its magnetic properties, and used for a sintered magnet, this the magnet proves more advantageous in magnetic properties and cost of production than a magnet using a magnetic powder obtained by the conventional electrolytic method or solution method. When the magnetic powder mentioned above is used in its unmodified state for a resin magnet, since it has not yet undergone the thermal treatment for the improvement of magnetic properties and further since this thermal treatment can no longer be adopted after the magnetic powder is mixed with resin, the produced resin magnet has the disadvantage that the magnetic properties thereof, particularly residual flux density, are notably inferior to those of a resin magnet made of the magnetic powder which has undergone the thermal treatment.

SUMMARY OF THE INVENTION

The inventors have made a diligent study in search of a way of eliminating the drawbacks mentioned above and developing a magnetic powder for a resin powder possessing an improved residual flux density and a high maximum energy product.

An object of this invention, therefore, is to provide a method for inexpensively producing a rare-earth element/cobalt magnetic powder substantially composed of (1-5) sing phase, which shows magnetic properties suitable for a resin magnet.

The inventors have now found that the object mentioned above is accomplished by a method which comprises mixing oxide of samarium and oxide of praseodymium, and optionally oxide of neodymium, with cobalt powder, thermally reducing the resulting mixture, thereby causing diffusion of the produced samarium and praseodymium, and optionally the produced neodymium, in the cobalt powder, subjecting the reaction product to a heat-treatment involving the steps of standing at 900° C. for 30 minutes to 5 hours and quenching from this temperature at a rate of not less than 10° C./minute, adding the product of this heat-treatment to water and converting it to a slurry, treating the slurry with water and aqueous acid solution, and comminuting the resulting product of the treatment into particles of an average diameter of 3 to 10 μm, thereby obtaining a magnetic powder having a composition of the general formula, $Sm_{1-x}Pr_{x-y}Co_z$ or $Sm_{1-x}Pr_{x-y}Nd_yCo_z$ (wherein x, y, and z satisfy the relations $0.05 \leqq x \leqq 0.40$, $0.01 \leqq y \leqq 0.39$, $0.01 \leqq x-y \leqq 0.39$, and $4.7 \leqq z \leqq 5.3$).

By the reduction-diffusion process, this invention enables a rare-earth element/cobalt magnetic powder suitable for a resin magnet possessing an improved residual flux density and a high maximum energy product through a heat treatment. Further, praseodymium and neodymium substituted for samarium occur abundantly and are less expensive than samarium. Thus, this invention enables inexpensive production of a rare-element substantially composed of (1-5) single phase cobalt magnetic powder suitable for a resin magnet and, therefore, has a profound economic significance.

DETAILED DESCRIPTION OF THE INVENTION

In the present invention, oxide of samarium and oxide of praseodymium and, optionally oxide of neodymium, are mixed with a reducing agent such as calcium and with cobalt powder and the resulting mixture is placed in a container and heated in an atmosphere of an inert gas such as argon under atmospheric pressure at 950° to 1,200° C. for 30 minutes to 4 hours. As the result, the oxide of samarium, the oxide of praseodymium, and the optionally added neodymium are reduced, and the samarium, the praseodymium, and/or the neodymium consequently produced are diffused in the cobalt powder. The resultant reaction product is subjected to a heat-treatment involving the steps of lowering the temperature of the product to 600° to 900° C., allowing the product to stand at the lowered temperature for 30 minutes to 5 hours, and quenching the product from this temperature at a rate of not less than 10° C./minute. In this heat-treatment, if the heating is made to a temperature not exceeding 600° C. for a period not exceeding 30 minutes, the effect of this treatment in converting the previously formed heterogeneous phase into a (1-5) single phase and eliminating thermal strain and conferring a stable coercive force is not us not sufficiently produced. If the heating is made to a temperature exceeding 90° C. for a period exceeding 5 hours, the composition of the produced magnetic powder is liable to deviate from the range to be defined afterward and the heat-treatment is liable to give rise to a heterogeneous phase other than the (1-5). Hence, the temperature range of 600° to 900° C. and the time range of 30 minutes to 5 hours have been selected as the heating conditions. The cooling after the heating is required to proceed at a rate of not less than 10° C./minute. The reason for this lower limit of the cooling rate is that the occurrence of a heterogeneous phase other than (1-5) is more liable to ensue.

Then, the product of the heat-treatment is added to water and converted into a slurry. This slurry is treated with water and an aqueous acid solution such as, for example, a dilute acetic acid. This treatment can be made by any of the methods heretofore adopted for treatments of this nature. The powder consequehtly obtained is comminuted into particles of an average diameter falling in the range of 3 to 10 μm. If the average particle diameter is less than 3 μm, the residual flux density is not sufficient. If it exceeds 10 μm, the coercive force is not sufficient. Hence, the average particle diameter has been defined in the range of 3 to 10 μm.

It is necessary that the magnetic powder obtained as described above should possess a composition meeting the following requirement.

(1) In the magnetic powder using oxide of samarium, oxide of praseodymium, and cobalt powder:

$$Sm_{1-x}Pr_xCO_z$$

(wherein x and z satisfy the relations $0.05 \leqq x \leqq 0.40$ and $4.7 \leqq z \leqq 5.3$).

(2) In the magnetic powder using oxide of samarium, oxide of praseodymium, oxide of neodymium, and cobalt powder:

$$Sm_{1-x}Pr_{x-y}Nd_yCo_z$$

(wherein x, y, and z satisfy the relations $0.05-x \leqq 0.4$, $0.01 \leqq y \leqq 0.39$, $0.01 \leqq x-y \leqq 0.39$ and $4.7 \leqq z \leqq 5.3$).

In the compositions mentioned above, if x is less than 0.05, the improvement of residual flux density owing to the addition of praseodymium alone or praseodymium and neodymium is not obtained sufficiently. If x exceeds 0.40, y is less than 0.01, y exceeds 0.39, x−y is less than 0.01, or x−y exceeds 0.39, the coercive force is not sufficient. If z is less than 4.7, heterogeneous phases of the (1-3) and the (2-7) are formed in the produced magnetic powder and the residual flux density is liable to fall. If z exceeds 5.3, a heterogeneous phase of the (2-17) is formed and the coercive force is liable to fall.

[EXAMPLE]

Now, the present invention will be described below with reference to working examples.

EXAMPLE 1

$Sm_2O_3$ powder, $Pr_6O_{11}$ powder, and Ca powder were mixed in respective amounts such as to give a prescribed composition (in a total amount of 120 to 130 g). The resulting mixture was held in an atmosphere of Ar inside an electric oven kept at 1,100° C. for three hours, then left cooling, and cooled from 900° C. with water. The resultant reaction product was treated with dilute acetic acid of a pH of about 2.5 to remove CaO and unaltered Ca from the reaction product. The powder consequehtly obtained was treated with ethyl alcohol to displace adhering water and then dried.

The powder was finely comminuted in a rotary ball mill.

The composition and average particle diameter of the resulting fine powder were as shown in Table 1.

TABLE 1

| | Test No. | Composition (% by weight) Sm | Pr | Co | Composition ($Sm_{1-x}Pr_xCo_z$) x | z | Average particle diameter μm |
|---|---|---|---|---|---|---|---|
| Comparative Experiment | 1 | 33.8 | 0.0 | 66.2 | 0.00 | 5.00 | 9.1 |
| | 2 | 30.5 | 3.2 | 66.3 | 0.10 | 4.99 | 8.2 |
| | 3 | 23.8 | 9.6 | 66.6 | 0.30 | 5.00 | 6.0 |
| | 4 | 20.4 | 12.7 | 66.7 | 0.40 | 4.99 | 5.3 |
| | 5 | 17.3 | 16.0 | 66.7 | 0.50 | 4.95 | 5.5 |
| | 6 | 10.3 | 22.5 | 67.2 | 0.70 | 5.00 | 6.4 |
| | 7 | 29.4 | 6.1 | 64.5 | 0.18 | 4.59 | 4.9 |
| | 8 | 30.5 | 1.5 | 68.0 | 0.05 | 5.41 | 6.6 |

Fine powder samples were prepared by following the procedure described above, except that the reaction product obtained in consequence of 3 hours' heating at 1,100° C. was left standing with the temperature of the electric oven lowered to 800° C. over a period of 1 hour, then held at the lowered temperature for 2 hours, suddenly cooled with a forced flow of Ar gas, and the product of the heat-treatment was treated with water and an aqueous acid solution. The compositions and average particle diameters of the fine powders were as shown in Table 2.

TABLE 2

| | Test No. | Composition (% by weight) Sm | Pr | Co | Composition ($Sm_{1-x}Pr_xCo_z$) x | z | Average particle diameter μm |
|---|---|---|---|---|---|---|---|
| Comparative Experiment | 9 | 33.8 | 0.0 | 66.2 | 0.00 | 5.00 | 8.3 |
| Example | 10 | 30.5 | 3.3 | 66.2 | 0.10 | 4.99 | 7.6 |
| Example | 11 | 23.8 | 9.6 | 66.6 | 0.30 | 5.00 | 9.2 |
| Example | 12 | 20.4 | 12.7 | 66.7 | 0.40 | 4.99 | 6.3 |
| Comparative Experiment | 13 | 17.3 | 16.0 | 66.7 | 0.50 | 4.95 | 5.0 |
| Comparative Experiment | 14 | 10.3 | 22.5 | 67.2 | 0.70 | 5.00 | 5.3 |
| Comparative Experiment | 15 | 29.4 | 6.1 | 64.5 | 0.18 | 4.59 | 4.6 |
| Comparative Experiment | 16 | 30.5 | 1.5 | 68.0 | 0.05 | 5.41 | 7.2 |

The magnetic powders prepared as described above were mixed with extrapolatively 5.0% by weight of epoxy resin and compression molded under a pressure of 4 tons/cm² in a magnetic field of 13 KOe. The molded mixture was held in an oven at 120° C. for 2 hours to cure the epoxy resin in the mold. The resin magnet so produced was tested for magnetic properties, i.e. coercive force ($B^{Hc}$), residual flux density (Br), and maximum energy product ($(BH)_{max}$). The results are shown in Table 3.

TABLE 3

| Heat-treatment not performed (comparative experiment) Test No. | $_BHc$ (KOe) | Br (KG) | $(BH)_{max}$ (MGOe) | Heat-treatment performed (working example) Test No. | | $_BHc$ (KOe) | Br (KG) | $(BH)_{max}$ (MGOe) |
|---|---|---|---|---|---|---|---|---|
| 1 | 5.30 | 6.55 | 10.00 | 9 | Comparative | 5.95 | 6.50 | 10.05 |

TABLE 3-continued

| Test No. | Heat-treatment not performed (comparative experiment) $_BHc$ (KOe) | Br (KG) | $(BH)_{max}$ (MGOe) | Test No. | Heat-treatment performed (working example) | $_BHc$ (KOe) | Br (KG) | $(BH)_{max}$ (MGOe) |
|---|---|---|---|---|---|---|---|---|
| | | | | | Experiment | | | |
| 2 | 5.25 | 7.30 | 11.05 | 10 | Example | 5.45 | 7.50 | 11.60 |
| 3 | 5.15 | 7.45 | 11.00 | 11 | Example | 5.25 | 7.55 | 11.50 |
| 4 | 5.10 | 7.45 | 10.50 | 12 | Example | 5.20 | 7.50 | 10.85 |
| 5 | 5.00 | 7.50 | 9.75 | 13 | Comparative Experiment | 4.15 | 7.50 | 9.80 |
| 6 | 2.60 | 7.45 | 7.00 | 14 | Comparative Experiment | 2.30 | 7.45 | 7.15 |
| 7 | 1.65 | 3.20 | 2.80 | 15 | Comparative Experiment | 1.80 | 3.05 | 2.45 |
| 8 | 1.50 | 3.30 | 2.65 | 16 | Comparative Experiment | 1.95 | 3.05 | 2.50 |

EXAMPLE 2

Mixtures prepared in the formulas of Test No. 1 and No. 2 of Example 1 (in total amounts of 120 to 260 g) were held in an atmosphere of Ar inside an electric oven at 1,100° C. for 2 hours. Then, the mixture of the formula of Test No. 1 was processed up to the fine comminution through the procedure not involving the heat-treatment (Test No. 17) and the mixture of the formula of Test No. 2 was subjected to the heat-treatment resorting to the steps of heating in the atmosphere of Ar gas and quenching with the forced flow of Ar gas, and then processed up to the fine comminution through the procedure involving the heat-treatment of Example 1 (Test Nos. 18–27).

The magnetic powders prepared as described above were severally mixed with extrapolatively 9.0% by weight of polyamide (nylon 6) and the resulting mixture was pelletized and injection molded in a magnetic field of 10 KOe. The resin magnets obtained as described above were tested for magnetic properties. The results are shown in Table 4.

TABLE 4

| | Test No. | Heat-treatment (°C.) × (hours) | $_BHc$ (KOe) | Br (KG) | $(BH)_{max}$ (MGOe) |
|---|---|---|---|---|---|
| Conventional | 17 | Heat treatment not performed | 5.50 | 6.30 | 9.05 |
| Comparative | 18 | 500° C. × 3 hr | 5.30 | 7.00 | 9.95 |

TABLE 4-continued

| | Test No. | Heat-treatment (°C.) × (hours) | $_BHc$ (KOe) | Br (KG) | $(BH)_{max}$ (MGOe) |
|---|---|---|---|---|---|
| Experiment | | | | | |
| Example | 19 | 620 × 1 | 5.20 | 7.10 | 10.60 |
| Example | 20 | 620 × 5 | 5.25 | 6.95 | 10.55 |
| Example | 21 | 700 × 0.5 | 5.30 | 6.95 | 10.50 |
| Example | 22 | 700 × 3 | 5.30 | 7.00 | 10.60 |
| Example | 23 | 800 × 2 | 5.25 | 7.00 | 10.50 |
| Comparative Experiment | 24 | 800 × 6 | 2.30 | 6.30 | 3.80 |
| Example | 25 | 880 × 1 | 5.25 | 7.05 | 10.60 |
| Example | 26 | 880 × 4 | 5.30 | 6.90 | 10.55 |
| Comparative Experiment | 27 | 1000 × 3 | 2.05 | 5.95 | 3.30 |

EXAMPLE 3

$Sm_2O_3$ powder, $Pr_6O_{11}$ powder, $Nd_2O_3$ powder, Co powder, and Ca powders were mixed in respective amounts (total amount 120 to 130 g) to produce mixtures of prescribed compositions. The resulting mixtures were processed by following the procedure of Example 1.

The powders consequently obtained were severally comminuted finely in a rotary ball mill. The compositions and average particle diameters of finely powdered samples are shown in Table 5.

TABLE 5

| | Test No. | Composition (% by weight) Sm | Pr | Nd | Co | Composition ($Sm_{1-x}Pr_{x-y}Nd_yCo_z$) x | y | x−y | z | Average particle (μm) |
|---|---|---|---|---|---|---|---|---|---|---|
| Comparative Experiment | 28 | 33.7 | 0.0 | 0.0 | 66.2 | 0.00 | 0.00 | 0.00 | 5.01 | 5.1 |
| | 29 | 30.4 | 3.2 | 0.0 | 66.4 | 0.10 | 0.00 | 0.10 | 5.03 | 5.8 |
| | 30 | 30.6 | 2.6 | 0.6 | 66.1 | 0.10 | 0.02 | 0.08 | 4.96 | 8.6 |
| | 31 | 30.1 | 1.9 | 1.3 | 66.7 | 0.10 | 0.04 | 0.06 | 5.10 | 4.2 |
| | 32 | 30.8 | 1.3 | 2.0 | 65.9 | 0.10 | 0.06 | 0.04 | 4.91 | 7.3 |
| | 33 | 30.5 | 0.6 | 2.6 | 66.3 | 0.10 | 0.08 | 0.02 | 5.00 | 6.1 |
| | 34 | 30.3 | 0.0 | 3.1 | 66.5 | 0.10 | 0.10 | 0.00 | 5.04 | 5.8 |
| | 35 | 32.9 | 2.0 | 1.4 | 63.7 | 0.10 | 0.04 | 0.06 | 4.45 | 5.8 |
| | 36 | 28.2 | 1.7 | 1.2 | 68.8 | 0.10 | 0.04 | 0.06 | 5.60 | 5.4 |
| | 37 | 23.1 | 9.3 | 0.0 | 67.5 | 0.30 | 0.00 | 0.30 | 5.21 | 6.1 |
| | 38 | 23.7 | 7.9 | 1.6 | 66.7 | 0.30 | 0.05 | 0.25 | 5.01 | 4.3 |
| | 38 | 24.1 | 6.1 | 3.3 | 66.1 | 0.30 | 0.10 | 0.20 | 4.90 | 9.0 |
| | 40 | 24.2 | 4.8 | 5.0 | 66.0 | 0.30 | 0.15 | 0.15 | 4.87 | 3.9 |
| | 41 | 23.4 | 3.1 | 6.4 | 67.1 | 0.30 | 0.20 | 0.10 | 5.12 | 4.3 |
| | 42 | 24.1 | 1.3 | 8.1 | 66.5 | 0.29 | 0.25 | 0.04 | 5.00 | 5.0 |
| | 43 | 23.1 | 0.0 | 9.5 | 67.3 | 0.30 | 0.30 | 0.00 | 5.20 | 5.3 |
| | 44 | 25.4 | 6.1 | 4.1 | 64.4 | 0.30 | 0.12 | 0.18 | 4.56 | 4.3 |
| | 45 | 22.5 | 4.5 | 4.6 | 68.4 | 0.30 | 0.15 | 0.15 | 5.43 | 3.9 |
| | 46 | 17.0 | 9.5 | 6.5 | 66.9 | 0.50 | 0.20 | 0.30 | 5.03 | 8.1 |
| | 47 | 17.0 | 3.2 | 13.0 | 66.8 | 0.50 | 0.40 | 0.10 | 5.01 | 7.4 |

Finely powdered samples were produced by following the procedure of Example 1, except that the reaction product obtained in consequence of 3 hours' heating at 1,100° C. was left standing with the temperature of the electric oven lowered to 800° C. over a period of 1 hour, then held at the lowered temperature for 2 hours, suddenly cooled with a forced flow of Ar gas, and the product of the heat-treatment was treated with water and an aqueous acid solution. The compositions and average particle diameters of the fine powders were as shown in Table 6.

TABLE 6

| | Test No. | Composition ($Sm_{1-x}Pr_{x-y}Nd_yCo_z$) x | y | x−y | z | Average particle diameter (μm) |
|---|---|---|---|---|---|---|
| Comparative Experiment | 48 | 0.00 | 0.00 | 0.00 | 5.01 | 4.6 |
| Comparative Experiment | 49 | 0.10 | 0.00 | 0.10 | 5.08 | 5.2 |
| Example | 50 | 0.10 | 0.02 | 0.08 | 5.10 | 4.8 |
| Example | 51 | 0.10 | 0.04 | 0.06 | 4.86 | 4.8 |
| Example | 52 | 0.10 | 0.06 | 0.04 | 4.92 | 5.1 |
| Example | 53 | 0.10 | 0.08 | 0.02 | 5.03 | 6.0 |
| Comparative Experiment | 54 | 0.10 | 0.10 | 0.00 | 5.04 | 3.3 |
| Comparative Experiment | 55 | 0.10 | 0.04 | 0.06 | 4.45 | 7.4 |
| Comparative Experiment | 56 | 0.10 | 0.05 | 0.05 | 5.60 | 7.2 |
| Comparative Experiment | 57 | 0.30 | 0.00 | 0.30 | 5.21 | 6.1 |
| Example | 58 | 0.30 | 0.05 | 0.25 | 5.01 | 6.5 |
| Example | 59 | 0.30 | 0.10 | 0.20 | 4.93 | 5.3 |

TABLE 6-continued

| | Test No. | Composition ($Sm_{1-x}Pr_{x-y}Nd_yCo_z$) x | y | x−y | z | Average particle diameter (μm) |
|---|---|---|---|---|---|---|
| Example | 60 | 0.30 | 0.15 | 0.15 | 4.90 | 8.0 |
| Example | 61 | 0.30 | 0.20 | 0.10 | 5.12 | 4.3 |
| Example | 62 | 0.29 | 0.25 | 0.04 | 5.00 | 5.3 |
| Comparative Experiment | 63 | 0.30 | 0.30 | 0.00 | 5.20 | 5.0 |
| Comparative Experiment | 64 | 0.30 | 0.12 | 0.18 | 4.56 | 4.9 |
| Comparative Experiment | 65 | 0.30 | 0.15 | 0.15 | 5.43 | 3.9 |
| Comparative Experiment | 66 | 0.50 | 0.20 | 0.30 | 5.03 | 4.0 |
| Comparative Experiment | 67 | 0.50 | 0.40 | 0.10 | 5.01 | 4.1 |

The magnetic powders prepared as described above were mixed with extrapolartively 5.0% by weight of epoxy resin and compression molded under a pressure of 4 tons/cm$^2$ in a magnetic field of 13 KOe. The molded mixture was held in an oven at 120° C. for 2 hours to cure the epoxy resin in the mold. The resin magnet so produced was tested for magnetic properties. The results are shown in Table 7.

TABLE 7

| Heat-treatment not performed (comparative experiment) | | | | Heat-treatment performed (working example) | | | | |
|---|---|---|---|---|---|---|---|---|
| Test No. | $_BHc$ (KOe) | Br (KGO) | $(BH)$max (MGOe) | Test No. | | $_BHc$ (KOe) | Br (KG) | $(BH)$max (MGOe) |
| 28 | 5.30 | 6.55 | 10.00 | 48 | Comparative Experiment | 5.95 | 6.50 | 10.05 |
| 29 | 5.25 | 7.30 | 11.0 | 49 | Comparative Experiment | 5.60 | 7.30 | 11.50 |
| 30 | 5.25 | 7.35 | 11.05 | 50 | Example | 5.75 | 7.40 | 11.55 |
| 31 | 5.30 | 7.35 | 11.05 | 51 | Example | 5.80 | 7.40 | 11.75 |
| 32 | 5.30 | 7.40 | 11.45 | 52 | Example | 5.85 | 7.45 | 12.05 |
| 33 | 5.35 | 7.40 | 11.50 | 53 | Example | 5.90 | 7.40 | 12.00 |
| 34 | 4.95 | 7.35 | 10.90 | 54 | Comparative Experiment | 5.40 | 7.40 | 11.20 |
| 35 | 1.60 | 3.15 | 2.75 | 55 | Comparative Experiment | 1.80 | 3.05 | 2.45 |
| 36 | 1.50 | 3.35 | 2.80 | 56 | Comparative Experiment | 1.75 | 3.00 | 2.40 |
| 37 | 5.15 | 7.45 | 10.95 | 57 | Comparative Experiment | 5.50 | 7.50 | 11.45 |
| 38 | 5.20 | 7.40 | 11.00 | 58 | Example | 5.55 | 7.50 | 11.60 |
| 39 | 5.25 | 7.40 | 11.15 | 59 | Example | 5.70 | 7.45 | 11.65 |
| 40 | 5.30 | 7.45 | 11.50 | 60 | Example | 5.85 | 7.50 | 12.00 |
| 41 | 5.30 | 7.50 | 11.45 | 61 | Example | 5.80 | 7.55 | 12.05 |
| 42 | 5.20 | 7.40 | 11.30 | 62 | Example | 5.75 | 7.50 | 11.90 |
| 43 | 5.00 | 7.30 | 10.85 | 63 | Comparative Experiment | 5.45 | 7.45 | 11.25 |
| 44 | 1.80 | 3.05 | 2.75 | 64 | Comparative Experiment | 1.80 | 2.95 | 2.90 |
| 45 | 1.75 | 3.10 | 2.75 | 65 | Comparative Experiment | 1.65 | 3.10 | 2.75 |
| 46 | 5.00 | 7.50 | 9.75 | 66 | Comparative Experiment | 5.30 | 7.45 | 9.95 |
| 47 | 5.05 | 7.45 | 9.70 | 67 | Comparative Experiment | 5.25 | 7.45 | 9.90 |

EXAMPLE 4

Mixtures prepared in the formulas of Test No. 28, No. 31, and No. 41 of Example 3 (in total amounts of 120 to 260 g) were held in an atmosphere of Ar inside an electric oven at 1,100° C. for 2 hours. Then, the mixture of the formula of Test 28 was processed up to the fine comminution through the procedure not involving the heat-treatment (Test No. 68) and the mixtures of the formulas of Test No. 31 and No. 41 were subjected to the heat-treatment resorting to the steps of heating in the atmosphere of Ar gas and quenching with the forced flow of Ar gas, and then processed up to the fine comminution, through the procedure involving the heat-treatment of Example 3 (Test Nos. 69–89).

The magnetic powders prepared as described above were severally mixed with extrapolatively 9.0% by weight of polyamide (nylon 6) and the resulting mixture was pelletized and injection molded in a magnetic field of 10 KOe. The resin magnets obtained as described above were tested for magnetic properties. The results shown in Table 8.

TABLE 8

| | Test No. | Heat-treatment (°C.) × (hours) | $_BHc$ (KOe) | Br (KG) | $(BH)_{max}$ (MGOe) |
|---|---|---|---|---|---|
| Conventional | 69 | Heat treatment not performed | 4.40 | 6.15 | 8.50 |
| Comparative Experiment | 70 | 500° C. × 3 hr | 3.90 | 6.25 | 10.00 |
| Example | 71 | 620 × 1 | 4.40 | 6.25 | 10.45 |
| Example | 72 | 620 × 5 | 4.45 | 6.30 | 10.50 |
| Example | 73 | 700 × 0.5 | 4.40 | 6.25 | 10.45 |
| Example | 74 | 700 × 3 | 4.50 | 6.30 | 10.55 |
| Example | 75 | 800 × 2 | 4.45 | 6.35 | 10.50 |
| Comparative Experiment | 76 | 800 × 6 | 2.20 | 6.00 | 3.90 |
| Example | 77 | 880 × 1 | 4.45 | 6.30 | 10.50 |
| Example | 78 | 880 × 4 | 4.50 | 6.25 | 10.55 |
| Comparative Experiment | 79 | 1000 × 3 | 2.15 | 5.95 | 3.85 |
| Comparative Experiment | 80 | 500 × 3 | 4.00 | 6.20 | 9.95 |
| Example | 81 | 620 × 1 | 4.45 | 6.25 | 10.40 |
| Example | 82 | 620 × 5 | 4.40 | 6.20 | 10.50 |
| Example | 83 | 700 × 0.5 | 4.45 | 6.25 | 10.45 |
| Example | 84 | 700 × 3 | 4.50 | 6.20 | 10.40 |
| Example | 85 | 800 × 2 | 4.50 | 6.30 | 10.45 |
| Comparative Experiment | 86 | 800 × 6 | 2.35 | 6.00 | 3.40 |
| Example | 87 | 880 × 1 | 4.45 | 6.25 | 10.50 |
| Example | 88 | 880 × 4 | 4.45 | 6.25 | 10.40 |
| Comparative Experiment | 89 | 1000 × 3 | 2.25 | 5.95 | 3.15 |

X ray diffraction analysis revealed that all Tests shown as Examples in the Tables are composed of (1–5) single phase.

We claim:

1. A method for production of a rare-earth element-/cobalt type magnetic powder for a resin magnet, comprising the steps of (1) preparing a mixture consisting of oxide of samarium, oxide of praseodymium, and cobalt powder, (2) thermally reducing said mixture to produce samarium and praseodymium and cause said produced samarium and praseodymium to diffuse into said cobalt powder and provide a resultant reaction product, (3) subjecting said resultant reaction product to a temperature of between 600° and 900° C. for 30 minutes to 5 hours, (4) quenching said resultant reaction product obtained in step (3) at a rate of not less than 10° C./minute, (5) adding the product of step (4) to water to thereby convert said product into a slurry, (6) treating said slurry with water and an aqueous acid solution to provide a resulting powder, and (7) comminuting said resulting powder into particles of an average diameter of 3 to 10 μm, thereby obtaining a magnetic powder having a composition represented by $Sm_{1-x}Pr_xCo_z$ (wherein x and z satisfy the relations $0.05 \leqq x \leqq 0.4$ and $4.7 \leqq z \leqq 5.3$).

2. A method according to claim 1, wherein said mixture prepared in step (1) further includes an oxide of neodymium, such that said produced magnetic powder possesses a formula represented by $Sm_{1-x}Pr_{x-y}Nd_yCo_z$ (wherein x, y and z satisfy the relations $0.05 \leqq x \leqq 0.40$, $0.01 \leqq y \leqq 0.39$, $0.01 \leqq x-y \leqq 0.39$ and $4.7 \leqq z \leqq 5.3$).

3. A method according to claim 1, wherein said mixture prepared in step (1) further includes a reducing agent.

4. A method according to claim 3, wherein said reducing agent is Ca.

5. A method according to claim 1, wherein said aqueous acid solution in step (6) is dilute acetic acid.

6. A method for production of rare-earth element-/cobalt type magnetic powder for a resin magnet, comprising the steps of (1) preparing a mixture consisting of oxide of samarium, oxide of praseodymium, oxide of neodymium, and cobalt powder, (2) thermally reducing said mixture to produce samarium and praseodymium, and neodymium, and to cause said produced samarium, praseodymium and neodymium to diffuse into said cobalt powder and provide a resultant reaction product, (3) subjecting said resulting reaction product to a temperature of between 600° and 900° C. for 30 minutes to 5 hours, (4) quenching said resultant reaction product obtained in step (3) at a rate of not less than 10° C./minute, (5) adding the product of step (4) to water to thereby convert said product into a slurry, (6) treating said slurry with water and an aqueous acid solution to provide a resulting powder, and (7) comminuting said resulting powder into particles of an average diameter of 3 to 10 μm, thereby obtaining a magnetic powder having a composition represented by $Sm_{1-x}Pr_{x-y}Nd_yCo_z$ (wherein x, y and z satisfy the relations $0.05 \leqq x \leqq 0.40$, $0.01 \leqq y \leqq 0.39$, $0.01 \leqq x-y \leqq 0.39$ and $4.7 \leqq z \leqq 5.3$).

7. A method according to claim 6, wherein said mixture prepared in step (1) further includes a reducing agent.

8. A method according to claim 7, wherein said reducing agent is Ca.

9. A method according to claim 6, wherein said aqueous acid solution in step (6) is dilute acetic acid.

* * * * *